United States Patent [19]

Bagnasco

[11] 4,071,927

[45] Feb. 7, 1978

[54] MOLDED SAFETY PIN

[76] Inventor: Dante Victor Bagnasco, 70 Harbor Hills Drive, Port Washington, N.Y. 11050

[21] Appl. No.: 718,359

[22] Filed: Aug. 27, 1976

[51] Int. Cl.[2] ..... A44B 9/10

[52] U.S. Cl. ..... 24/156; 24/161

[58] Field of Search ..... 24/156, 161, 160, 155 SP, 24/150 SP, 157 P

[56] References Cited

U.S. PATENT DOCUMENTS

| | | | |
|---|---|---|---|
| 670,105 | 3/1901 | Huberty | 24/156 R |
| 849,558 | 4/1907 | Newman | 24/150 SP |
| 1,983,186 | 12/1934 | Novat | 24/150 SP |
| 2,227,676 | 1/1941 | Schwartz et al. | 24/DIG. 14 |
| 2,760,247 | 8/1952 | Bagnasco | 24/156 R |
| 3,047,921 | 8/1962 | Lorber | 24/161 R |
| 3,883,930 | 5/1975 | Bagnasco | 24/156 R |
| 3,972,094 | 8/1976 | Fuller | 24/150 SP |

*Primary Examiner*—Kenneth Downey
*Attorney, Agent, or Firm*—Orin R. Severn

[57] ABSTRACT

Safety pin comprising an integrated molded unit having an elongated plastic base with a flexible and resilient extension at each end thereof, a pin secured to one extension, the other extension being reversely bowed toward the base to form a detent for the piercing end of the pin, and pin guiding structure integral with and extending from opposite sides of the molded base so as to arch over the detent. In another form of the invention, the molded unit has a resilient metal strip of U-shape (in lieu of a molded extension) that is locked to the base to form the detent.

5 Claims, 11 Drawing Figures

MOLDED SAFETY PIN

BACKGROUND OF THE INVENTION

The invention relates to safety pins of the positive locking type, wherein the piercing end of the biased pin shaft is manually depressed from its open position and moved into a restraining or locking detent, and wherein the pin can be subsequently released only by joint manipulation of the pin shaft and locking detent. Safety pins of this character are disclosed for example, in my U.S. Pat. Nos. 2,546,662, 2,760,247, 3,018,533, and 3,883,930. The present invention is concerned with improvements on my prior patents and is particularly directed to an improved safety pin of inexpensive molded construction.

SUMMARY OF INVENTION

In accordance with the invention, the complete safety pin essentially constitutes a molded unit. In one form, the molded unit which is made of a plastic material, comprises an elongated flat and comparatively rigid base member having extending from each end thereof a flexible, resilient member that is reduced in cross-sectional area as compared with the base. The base and its extensions are made of a suitable plastic material such as polypropylene which has both mechanical strength and characteristic resiliency. This material therefore can be shaped and proportioned by molding for comparative rigidity and flexibility.

A pin is anchored at one end to one of the resilient extensions, so as to be biased toward open position; the opposite extension is of U-shape so as to bow in reverse direction toward the base. The free end of the "U" is formed as a detent which restrains the piercing end of the pin when it is forced beneath the detent into closed position. The molded base also has comparatively rigid lateral extensions or wings that form an archlike pin guide overhanging the detent extension.

In another form of the invention, the molded detent extension of the base is replaced by a separate U-shaped resilient member of material such as spring steel, that is united to the molded base unit by a simple snap-lock device.

A principal object of the invention therefore, is an improved safety pin of the positive locking type, constituting a single unit that can be inexpensively and easily molded for quantity production.

A further and related object of the invention is an improved safety pin of the character described above, that can be easily closed and opened indefinitely without malfunction, that is rugged and resistant to corrosion and maladjustment, and which will remain closed against corroidal opening when closed but which may be readily opened.

Other objects, features and advantages will appear from the following description with reference to the accompanying drawings.

DESCRIPTION OF PREFERRED EMBODIMENT

Figure 1:
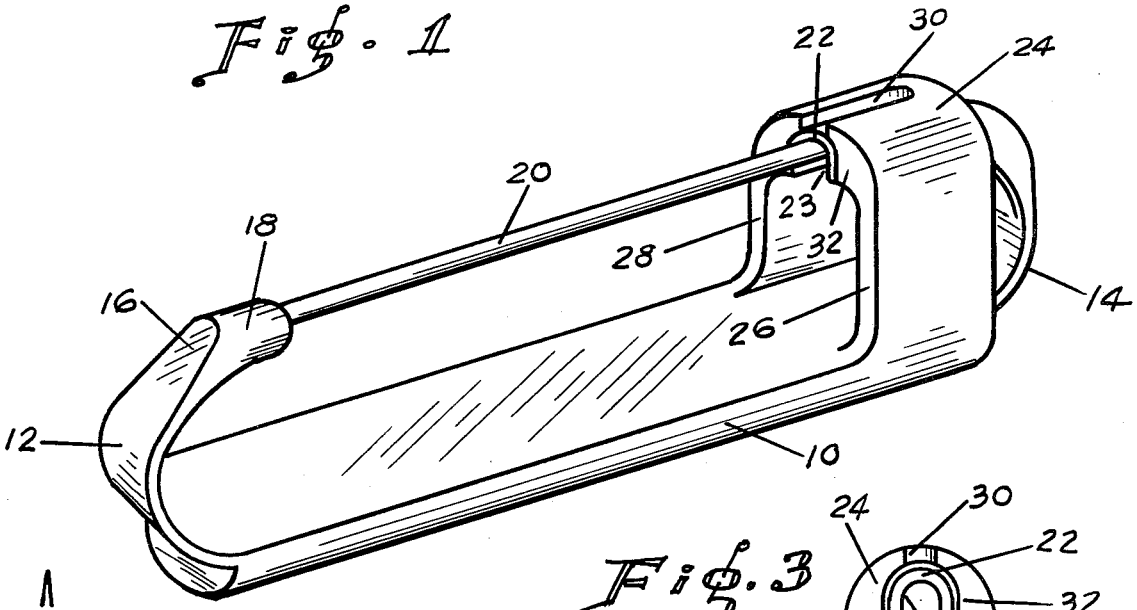
FIG. 1 is a view in perspective of a safety pin embodying the invention in the closed position thereof.

The safety pin shown generally by FIG. 1 in its closed and locked position, constitutes an integral unit essentially of plastic material, and is formed by a single molding operation. The molded unit comprises a main support or base member 10 that is formed as a comparatively rigid strip having resilient, flexible extensions 12 and 14 at opposite ends thereof, respectively.

In accordance with the invention, a plastic material is selected for the molded unit that has characteristic rigidity, flexibility and resiliency, according to the physical proportions and dimensions of the part in question, an example being polypropylene. The base member 10 is represented as a comparatively rigid strip of substantial thickness and width, whereas the comparatively thin extensions 12 and 14 which are of the same material as the base, are proportioned as to thickness, width, and taper so as to have both flexibility and resiliency.

Figure 3:
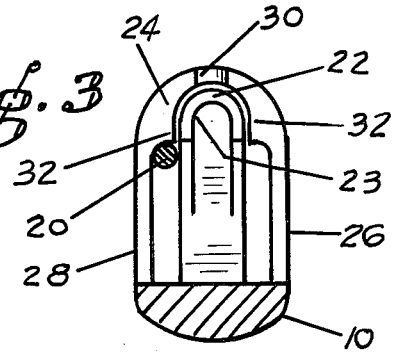
FIG. 3 is a transverse sectional view taken along the line 3 — 3 of FIG. 2.
Figure 2:
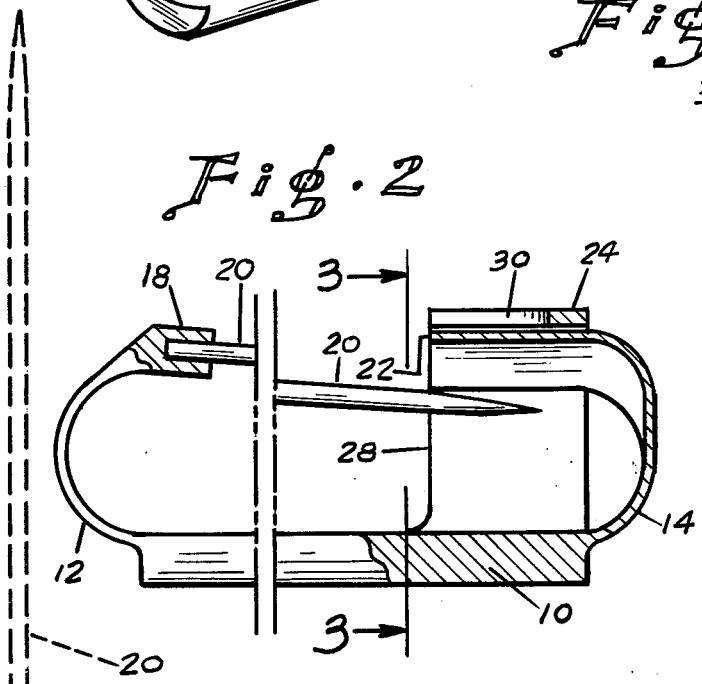
FIG. 2 is a longitudinal sectional view partly broken away, of the safety pin of FIG. 1 in an initial stage of opening.

As shown in FIGS. 1 – 3, the extension 12 is a merged continuation of the base member 10 comprising a flexible, resilient web-like strip thinner than the base, and has a tapered section 16, FIG. 1, that terminates in an enlarged portion 18. A pin 20 is suitably anchored during molding in this portion. The opposite extension 14 which comprises the pin detent or clasp 22 is likewise comparatively thin at the base member and has a gradual taper as it bows in reverse direction and terminates in the pin detent. A pin guiding and shielding structure 24 that forms part of and extends from opposite sides of the base member, makes an arch closely overhanging the detent 22, FIG. 2.

Figure 4:
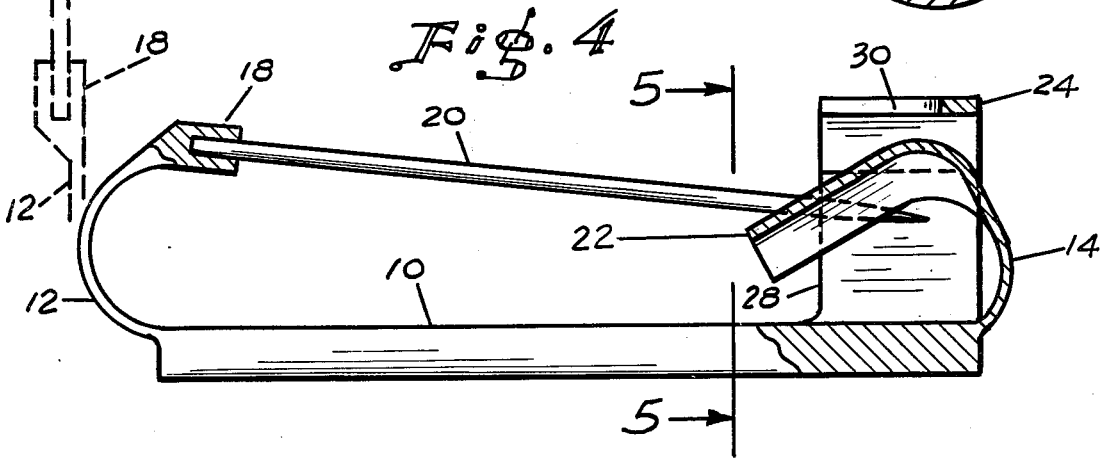
FIG. 4 is a longitudinal sectional view similar to FIG. 2, showing the safety pin in a second stage of opening.

As described, each extension can be readily flexed manually and when so fixed away from its original or molded position, i.e. the dotted-line position of extension 12, FIG. 4, and the section view of extension 14, FIG. 2, its inherent resiliency opposes the flexing force. Thus, in the absence of restraint, the extension 12 (with pin 20) tends to assume the open or dotted-line vertical position of FIG. 4, and the extensions 14 (with detent 22) normally assumes a loop shape as in FIGS. 1 and 4, wherein the upper side of the loop is substantially parallel with the base. Accordingly, when the pin 20 engages and is restrained by the under or concave side of the detent 22 in the closed position, FIG. 1, the upward bias of the pin tends to expand the loop and move the detent against the overhanging pin guide 24.

The pin guide 24 constitutes a molded part of the base and comprises a pair of uprights or wing-like extensions 26 and 28 that merge with opposite sides of the base member, and that unite at the top to form an arch over the detent 22 as described above. The arch has an open-end slot 30 for receiving the pointed end of the pin.

The pin closing and opening operations are performed generally in the manner described in my Patent 3,883,930. In brief, when the pin is in the open or dotted-line position, FIG. 4, the detent 22 and extension 14 are both unflexed, FIG. 2. The pin is closed simply by pressing the pin over the base against the bias of the resilient extension 12 and downward into the pin guide slot 30 and applying sufficient additional pressure to force the detent downward to form a space between the oppositely curved sides of the detent and the pin guide. As continued pressure is applied to the pin, it is cammed into this space by the detent, either to one side or the other, so as to ride downwardly along one of the pin guide lips 32 until it passes the lower edge of the detent. At this point, the detent snaps back to its normal position, FIGS. 2 and 3. The pin is now released, and under its own bias it moves upward into the concave portion 23 of the detent, FIG. 1, where it is effectively locked in closed position against accidental release. In this position, the pin also presses the detent against the overhanging pin-guide arch so as to completely close the slot 30.

Figure 5:
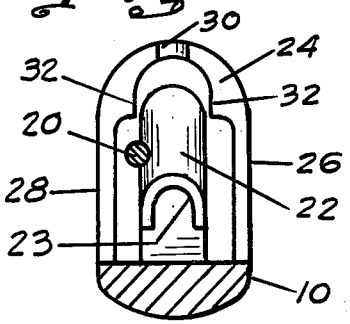
FIG. 5 is a transverse section taken along the line 5 — 5 of FIG. 4.

The pin opening operation requires two separate manipulations, thereby precluding for all practical purposes accidental opening. The pin 20 is manually depressed and pushed laterally until it clears the lower edge of the detent, as shown in FIGS. 2 and 3. The detent 22 is also lowered to a point below the pin, FIGS. 4 and 5, by manual pressure on the flexible extension 14. As best shown in FIG. 5, the pin is now free under bias of the resilient extension 12, to move upward and through the slot 30 to open position.

As indicated in the drawings, the pin 20 may constitute a metal insert that is suitably anchored in the plastic extension 12. However, if desired the complete safety pin, including the pin 20, may be made in one solid plastic unit of a reinforced formulation of polypropylene, or plastic of similar characteristics.

Figure 10:
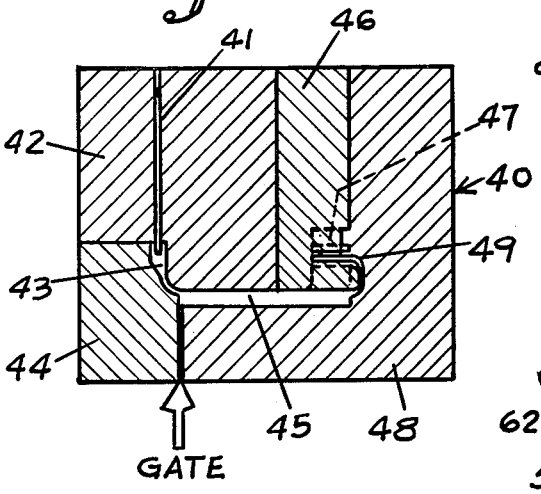
FIG. 10 is a sectional view of an assembled single-cavity mold for making the safety pin of FIG. 1.

A method of molding the safety pin shown by FIGS. 1 – 5 is described in connection with FIGS. 10 and 11. A single-cavity mold 40 shown in FIG. 10 comprises four co-related sections 42, 44, 46, and 48. The section 42 has a tubular opening 41 for receiving the pin 20 prior to molding (or for forming a plastic pin). The opening communicates with a cavity 43 formed between the sections 42 and 44. The cavity 43, which is for the pin extension 12, merges with the main base cavity 45 that is formed between the sections 42, 46 and 48. A gate as indicated, can be located at one end of the base cavity between sections 44 and 48. The sections 46 and 48 form between them the cavities 47 and 49 for the pin guide 24 and detent extension 14, respectively.

Figure 11:
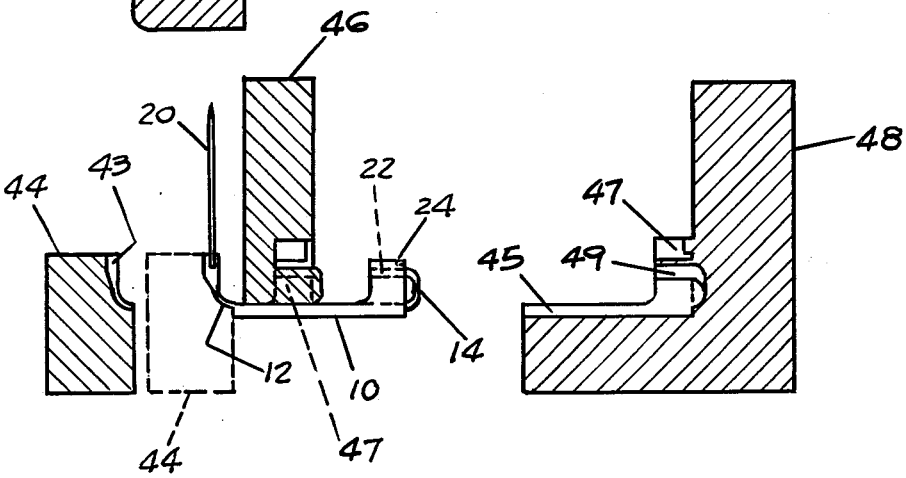
FIG. 11 illustrates the multiple-part mold of FIG. 10 during the final ejection process.

FIG. 11 shows an arrangement of the mold sections for the ejection process after molding. The section 42 is raised vertically, and the section 48 moved laterally to the right as viewed, freeing the main body 10 of the pin. Section 44 is then moved laterally to the right as shown by the dotted view, ejecting the completed pin from mold section 46 as illustrated. Section 46 is held stationary at all times. It will be apparent that the mold and ejection technique can be varied as preferred according to the state of the art.

Figure 7:
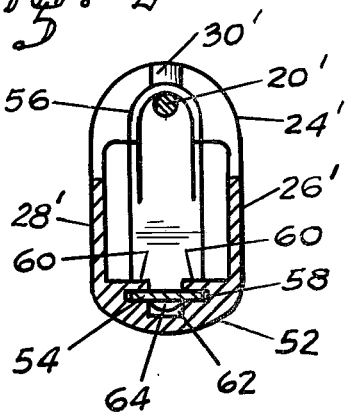
FIG. 7 is a transverse section taken along the line 7 — 7 of FIG. 6.
Figure 8:
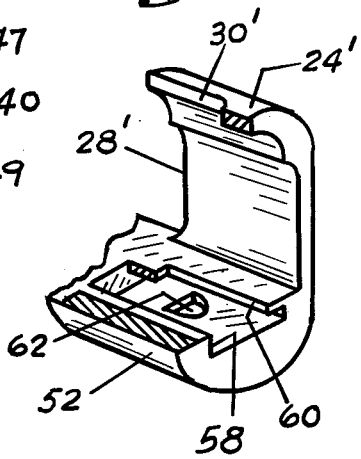
FIGS. 8 and 9 are perspective views of detail features respectively, of the safety pin of FIG. 6.
Figure 9:
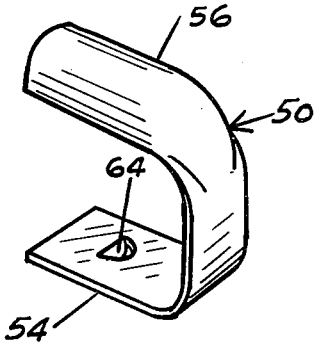
Figure 9:
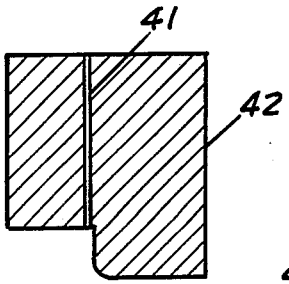

Another form of the invention is shown by FIGS. 6 – 9 wherein the detent element comprises a separate member 50 that can be permanently locked to the molded base member 52. The molded flexible extension 12′ for the pin 20° and the pin guide structure 24′ are integral with the base, essentially as described above. The detent element 50 comprises a strip of spring metal, generally of U-shape, as shown in FIG. 9. One leg 54 of the "U" is flat and the opposite leg 56 which constitutes the detent, is narrowed and bend to form a channel-like strip of concave cross-section, FIGS. 7 and 9.

Figure 6:
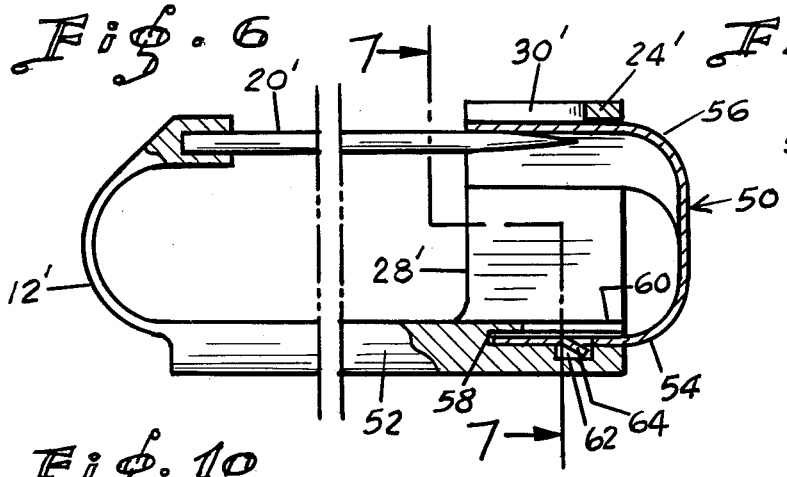
FIG. 6 is a partial view in longitudinal section of another form of the invention.

The base member 52 has a slot 58 that is located between the wings 26′ and 28′ of the pin guide 24′ and extends from the end of the base a sufficient distance to accommodate the U-leg 54. The slot 58 is defined by overhanging flanges 60 and corresponds in width to that of the leg 54 for ensuring a snug fit thereof. The base 52 has at the bottom of the slot a cavity 62 for receiving a leg-locking member comprising a spring tab 64 extending from the outer side of the leg 54. The tab is formed by a partial punchout of the leg as indicated in FIG. 6 and its angle is such that when the U-leg 54 is first inserted in the slot 58, the tab is flexed into flush relation with the leg. When the tab moves over the cavity 62, it snaps into the locking position shown in FIG. 6 whereby the detent element is firmly secured and locked to the base. In this position, the spring detent 50 can be flexed to operate in the manner described above.

In the alternative arrangement shown by FIG. 6 – 9 above, the molding operation can be generally similar to that described above for making the base 52, flexible extension 12′ with pin 20′, and the wing guides 26′ and 28′. The recess 62 for retaining the detent 50 in the base 52, FIGS. 6 – 8, is formed by a vertically sliding sub-section within the mold section 46 according to well-known molding technique. In addition, the mold section 48 will have the appropriate contours to form the base slot 58, overhanging flanges 60 and the side wings 26′ and 28′.

Although in the preferred form, the base extension carrying the pin is shown as molded at approximately 90° with respect to the base, it is within the spirit of the invention to mold the extension with pin in longitudinal or linear relation to the base. In this form, the pin would be swung through an arc of about 180° to close, and would be in substantial linear alignment with the base in the open position.

Having set forth the invention in what is considered to be the best embodiment thereof, it will be understood that changes may be made in the apparatus and molding techniques as above set forth without departing from the spirit of the invention or exceeding the scope thereof as defined in the following claims.

What I claim is:

1. A safety pin of the character described comprising an elongated strip-like molded base member composed of resilient plastic material having sufficient thickness to provide a comparatively rigid base, said base member at one end merging into a comparatively thin web-like flexible extension tapered in width toward the outer end thereof, a pin extending longitudinally from the tapered end of said extension so that it can be readily biased back over the base member, and a detent extending in a reverse loop from the opposite end of said base member for retaining said pin in closed position when it is moved beneath the detent, said base member also including as a molded part thereof wing-like pin guiding structure extending transversely from the base at opposite sides of the detent to partly enclose and overlie said detent.

2. A safety pin as specified in claim 1 wherein the detent comprises an integral web-like flexible and resilient extension of the opposite end of the molded base member.

3. A safety pin as specified in claim 2 wherein the base member, together with the flexible end extensions and pin guiding structure form an all-plastic integrated molded unit composed of a plastic characteristic of a reinforced formulation of polypropylene and and a metal pin is anchored in the tapered flexible extension.

4. A safety pin as specified in claim 1 wherein the detent comprises a separate resilient member of generally U-shape, one arm of the "U" being secured to the plastic base member and the other arm normally biased to engage the overhanging pin guide structure and constituting the pin restraining portion.

5. A safety pin as specified in claim 4 wherein the base member is slotted to receive the secured arm of the "U", and the base and said arm have interlocking parts for permanently securing the detent to the base member.

* * * * *